United States Patent [19]

Boyd

[11] Patent Number: 4,934,138

[45] Date of Patent: Jun. 19, 1990

[54] HIGH TEMPERATURE TURBINE ENGINE STRUCTURE

[75] Inventor: Gary L. Boyd, Tempe, Ariz.

[73] Assignee: Allied-Signal Inc., Morris Township, Morris County, N.J.

[21] Appl. No.: 280,761

[22] Filed: Dec. 6, 1988

[51] Int. Cl.[5] ..... F02C 3/00

[52] U.S. Cl. ..... 60/39.75; 416/244 A; 416/241 B

[58] Field of Search ..... 60/39.75, 39.32, 39.02; 416/204 A, 244 A, 244 R, 198 A, 241 B; 415/214.1; 403/370

[56] References Cited

U.S. PATENT DOCUMENTS

| | | | |
|---|---|---|---|
| 1,551,402 | 8/1925 | Junggrew | 416/198 A |
| 1,721,060 | 7/1929 | Swartz . | |
| 2,297,508 | 9/1942 | Schutte | 416/244 R |
| 2,660,399 | 11/1953 | Robinson et al. | 416/198 R |
| 3,304,052 | 2/1967 | Warner et al. | 416/244 R |
| 3,335,580 | 8/1967 | Simpson, Jr. . | |
| 3,356,339 | 12/1967 | Thomas et al. | 416/244 R |
| 3,604,819 | 9/1971 | Krahe et al. . | |
| 3,680,979 | 8/1972 | Hansen | 416/198 R |
| 3,872,691 | 3/1975 | Hildebrandt . | |
| 3,941,506 | 3/1976 | Robb et al. | 416/244 A |
| 3,943,703 | 3/1976 | Kronogard | 60/39.32 |
| 3,976,399 | 8/1976 | Schmoch | 416/198 A |
| 4,011,737 | 3/1977 | Kruger . | |
| 4,152,096 | 5/1979 | Murakami et al. | 415/214.1 |
| 4,176,519 | 12/1979 | Kronogard | 60/39.32 |
| 4,247,256 | 1/1981 | Maghon | 416/244 A |
| 4,537,560 | 8/1985 | Emeterro | 416/198 A |
| 4,682,934 | 7/1987 | Knorowski | 416/244 A |
| 4,832,574 | 5/1989 | Woodwell et al. | 416/244 A |

FOREIGN PATENT DOCUMENTS

| | | | |
|---|---|---|---|
| 735504 | 4/1943 | Fed. Rep. of Germany . | |
| 2714209 | 10/1977 | Fed. Rep. of Germany | 416/241 B |
| 57-168004 | 10/1982 | Japan | 416/241 B |
| 578533 | 7/1946 | United Kingdom | 416/241 B |
| 2034440 | 6/1980 | United Kingdom | 416/241 B |

OTHER PUBLICATIONS

Ceramic Design Methodology and the AGT101 Tech. Paper 3/1985 by Gary L. Boyd et al.

Automotive Gas Turbine Ceramic Component Testing Tech. Paper by Carruthers et al.

*Primary Examiner*—Louis J. Casaregola

*Assistant Examiner*—Timothy S. Thorpe

*Attorney, Agent, or Firm*—Terry L. Miller; James W. McFarland; Robert A. Walsh

[57] ABSTRACT

A high temperature turbine engine includes a hybrid ceramic/metallic rotor member having ceramic/metal joint structure. The disclosed joint is able to endure higher temperatures than previously possible, and aids in controlling heat transfer in the rotor member.

11 Claims, 2 Drawing Sheets

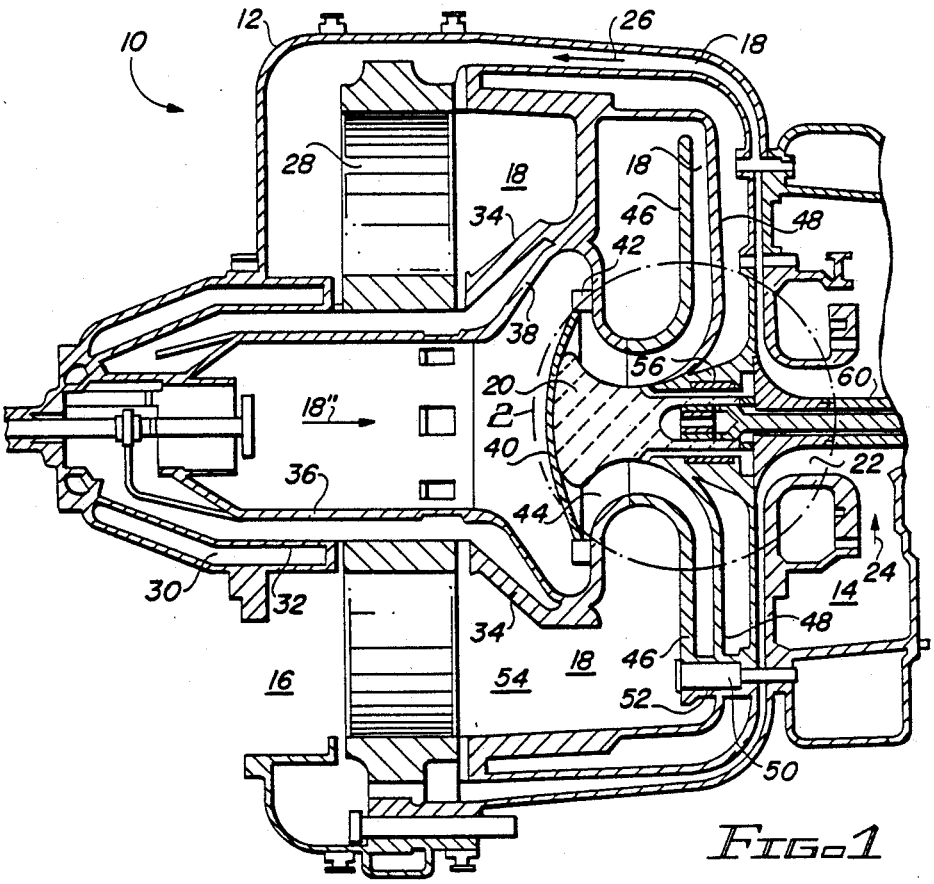
FIG-1
FIG-2
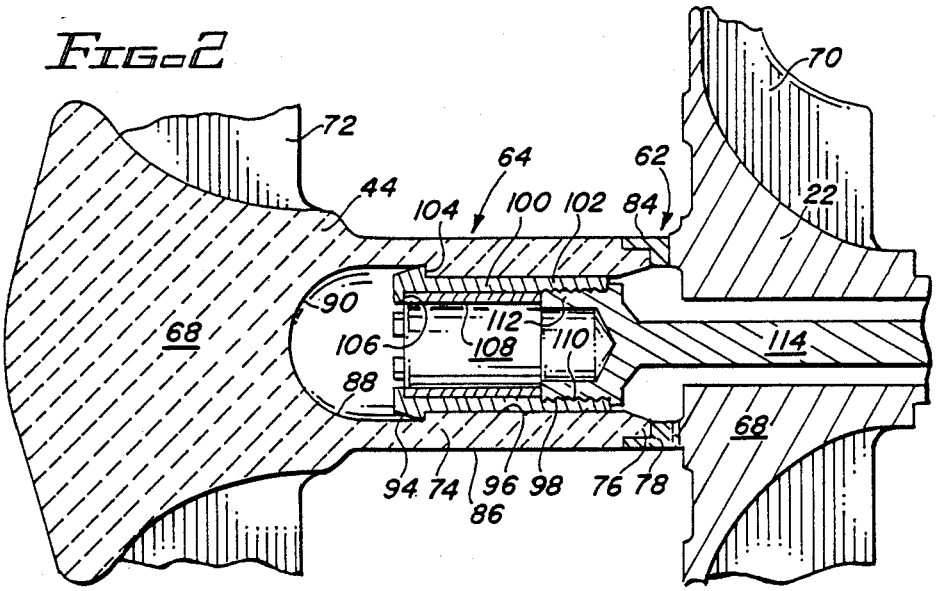

HIGH TEMPERATURE TURBINE ENGINE STRUCTURE

The United States Government has rights in the present invention pursuant to Contract No. DEN3-167 issued and funded by the Department of Energy (DOE), and administered by the National Aeronautics and Space Administration (NASA).

TECHNICAL FIELD

The present invention is in the field of high temperature turbine engine structure. Particularly, the present invention is directed to structure of a high temperature turbine engine composed of both metallic and ceramic components.

BACKGROUND OF THE INVENTION

A long-recognized need in the turbine engine art has been to attain higher operating temperatures in order to achieve both a greater thermodynamic efficiency and an increased power output per unit of engine weight. Ideally, a turbine engine should operate with stoichiometric combustion in order to extract the greatest possible energy value from the fuel consumed. However, the temperatures resulting from stoichiometric and even near-stoichiometric combustion are beyond the endurance capabilities of metallic turbine engine components. Consequently, as the turbine engine art has progressed, an ever greater emphasis has been placed upon both enhanced cooling techniques and the development of temperature and oxidation resistant metals for use in components of the engine which are exposed to the highest temperatures. That is, cooling techniques and high temperature metals have been developed for each of combustion chambers, turbine stator nozzles, and turbine blades. This quest has led to the development of elaborate cooling schemes for all of these components as well as to classes of nickel-based "super alloy" metals which may be cast using directionally solidified or single crystal techniques. All in all, the quest for higher operating temperatures in a turbine engine fabricated of metallic components has led to a still increasing complexity and expense in the making of the engine.

An alternative approach to the attainment of higher operating temperatures in a turbine engine has been recognized. This approach involves the use of high-strength ceramic components in the engine. Ceramic components are better able than metals to withstand the high temperature oxidizing environment of a turbine engine. However, the term "high strength" in connection with ceramic structures must be viewed in context. While many ceramic materials exhibit superior high temperature strength and oxidation resistance, ceramics have historically been difficult to employ in turbine engines because of a comparatively low tensile fracture strength and a low defect tolerance. Consequently, a long-recognized need has been for the development of hybrid ceramic/metallic structures which utilize the characteristics of each material to best advantage in order to allow combustion in a turbine engine to take place closer to or at the stoichiometric level.

SUMMARY OF THE INVENTION

In view of the deficiencies of the conventional turbine engine art, and of the materials of construction and structural techniques available for making such engines, it is a primary object for this invention to provide a hybrid ceramic/metallic rotor structure for a turbine engine.

More particularly, it is an object for this invention to provide a structure uniting a ceramic turbine rotor portion with a metallic shaft portion for torque transmitting corotation with retention of axial and radial selected relationships, and allowance of differential thermal and centrifugal relative movements between the portions.

Still further, it is an object for this invention to provide a turbine engine wherein a ceramic turbine rotor portion and an axially adjacent metallic compressor rotor portion are coaxially united for torque transmitting corotation to define a substantial portion of a turbine engine rotor member.

Accordingly, the present invention provides a hybrid ceramic/metallic structure comprising: a first ceramic portion defining a respective first axially extending bore opening outwardly thereon, said first portion further defining on said first bore an annular step disposed away from said bore opening, a second portion axially adjacent said first ceramic portion, a metallic annular collet member received into said first bore and including a circumferentially arrayed plurality of axially elongate radially resilient finger portions, said plurality of finger portions proximate the distal end thereof defining a radially outwardly extending shoulder engaging said step, tensile means engaging said collet member and extending axially toward said second portion for applying an axially directed tensile force to the collet member which force is reacted through the second portion to secure the latter and said first portion axially together.

An advantage of the present invention is that it provides a hybrid ceramic/metallic turbine engine rotor member wherein the beneficial characteristics of each material are employed to best advantage.

Another advantage of the present invention resides in the positive axial and concentric mutual torque transmitting interrelationship established between the ceramic and metallic portions of the inventive rotor member.

Further to the above, because of the strong coaxially concentric relationship of the ceramic and metallic rotor member portions, a radially outwardly directed axially extending cylindrical surface part of the ceramic portion may be employed to define a journal bearing surface. That is, the rotor member may be journaled in a turbine engine by an external surface part of the ceramic portion so that only one additional bearing is required to satisfactorily support the rotor member. This one additional bearing may be located in a comparatively cooler portion of the turbine engine.

Additional objects and advantages of the present invention will appear from a reading of the following detailed description of a single preferred embodiment of the invention taken in conjunction with the appended drawing figures.

BRIEF DESCRIPTION OF THE DRAWINGS

FIG. 1 provides a fragmentary longitudinal view, partly in cross section of a hybrid ceramic/metallic turbine engine embodying the invention;

FIG. 2 depicts an enlarged fragmentary cross sectional view of a portion of the engine presented by FIG. 1 with parts thereof omitted for clarity of illustration.

BEST MODE FOR CARRYING OUT THE INVENTION

Figure 3:
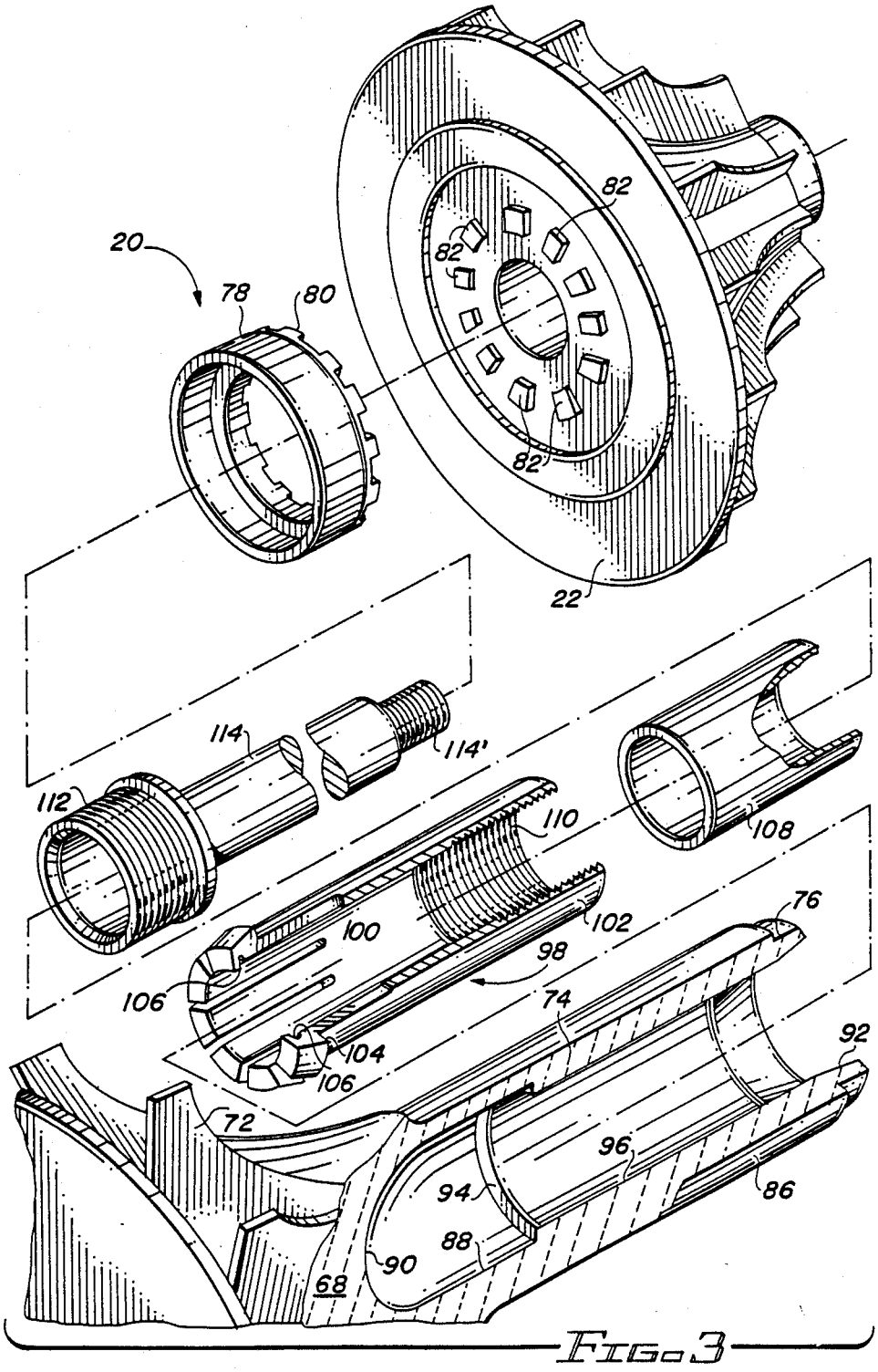
FIG. 3 provides an exploded perspective view of a turbine rotor assembly portion of the turbine engine, with parts thereof omitted or broken away for clarity of illustration.

FIG. 1 depicts a hybrid ceramic metallic turbine engine 10. The engine 10 includes a housing 12 which defines an inlet 14, an outlet 16, and a tortuous flow path 18 communicating the inlet 14 with the outlet 16 for conveying a flow of fluid therebetween. A hybrid ceramic/metallic rotor member generally referenced with the numeral 20 is journaled in the housing 12 and cooperates therewith to bound the flow path 18. It will be seen that the rotor member 20 includes a compressor rotor portion 22, rotation of which inducts ambient air via inlet 14, as indicated by arrow 24, and delivers this air pressurized to a flow path section 18' as indicated by arrow 26.

The flow path section 18' leads axially through a segment of somewhat less than 180° of a rotary annular regenerator member 28 which is received in the housing 12. Downstream of the regenerator 28, the flow path 18 leads through an axially extending combustion structure generally referenced with the numeral 30. The combustor structure 30 is fabricated of ceramic material and includes a ceramic outer liner 32 which is supported at one end by a generally cone-shaped outer transition member 34. A ceramic inner combustion liner 36 is coaxially disposed within the outer liner 32, and is supported at one end on a ceramic transition duct member 38. The flow path 18 leads axially toward the one end of the combustion liner 36, as indicated by arrow 18". Within the transition duct member 38, a ceramic turbine back shroud member 40 and a ceramic turbine stator member 42 cooperatively define the flow path 18, and lead the latter radially inwardly to a ceramic turbine rotor portion 44 of the rotor member 20.

Downstream of the turbine rotor portion 44, the flow path 18 extends axially and radially outwardly between a pair of spaced apart cooperative ceramic exhaust duct members, respectively referenced with the numerals 46,48. A plurality of hybrid ceramic/metallic fastener members 50 (one of which is visible in FIG. 1) cooperatively engage the one exhaust duct member 46 and the housing 12. A ceramic spacer member 52 received over the fastener members 50 spaces apart the duct members 46,48.

Subsequent to the exhaust duct members 46,48, the flow path 18 leads to an exhaust chamber generally referenced with the numeral 54. A segment of somewhat less than 180° of the ceramic regenerator member 28 is exposed to the exhaust chamber 54. Consequently, the flow path 18 leads once again through the regenerator member 28, and to ambient via the outlet 16.

In order to complete this description of the engine 10, it must be noted that in the combustor 30 fuel is added to the pressurized air flowing from compressor rotor 22 to support combustion. This combustion results in a flow of high temperature pressurized combustion products flowing downstream in the combustor 30, and in flow path 18 subsequent to the combustor. Also, the rotor member 20 is journaled in housing 12 by a journal bearing 56 disposed between the rotor portions 22 and 44, and a rolling element bearing (not visible in the figures) disposed adjacent a metallic power output shaft portion 60 (only a portion of which is visible in FIG. 1) of the rotor member 20.

Viewing now FIGS. 2 and 3 in conjunction, it will be seen that the hybrid ceramic/metallic rotor member 20 includes not only the metallic compressor rotor portion 22, the ceramic turbine rotor portion 44, and metallic power output shaft portion 60(not visible in FIGS. 2 and 3), but also a torque transmitting and concentricity retaining coupling structure generally referenced with the numeral 62, and an axial retention coupling structure generally referenced with the numeral 64. The coupling structures 62 and 64 are cooperative to unite the portions 22, 44 and 60 to define the rotor member 20.

Both the metallic compressor rotor portion 22 and the ceramic turbine rotor portion 44 include an individual hub part, respectively referenced with the numerals 66 and 68. Similarly, each of the rotor portions 22 and 44 include a plurality of circumferentially arrayed integral blade parts, respectively referenced with the numerals 70 and 72, which extend both axially and radially outwardly on the hub parts 66,68. The turbine rotor portion 44 includes an integral elongate axially extending stepped cylindrical boss part 74 extending from the hub 44 toward the compressor rotor portion 22. Carried upon a reduced diameter end part 76 of the cylindrical part 74 is a metallic collar member 78. The collar member 78 on one side defines a plurality of radially and axially extending circumferentially arrayed curvic coupling teeth 80 which mesh with a similar array of curvic teeth 82 defined by the hub part 66 of rotor portion 22. Because of the intermeshing of the teeth 80,82, the hub part 66 and collar member 78 are coupled in torque transmitting relation, and are also retained concentrically to one another while allowing for differential thermal and centrifugal expansions of these components.

In order to unite with the cylindrical part 74 of the rotor portion 44, the collar member 78 includes an axially extending band portion 84 circumscribing the reduced diameter end part 76 of rotor portion 44. The band portion 84 and reduced diameter part 76 define an interference fit therebetween so that collar 78 is permanently united with rotor portion 44. Preferably, the interference fit between band portion 84 and part 76 of the rotor member 44 is established by separately relatively heating the collar 78 while relatively cooling the rotor part 76. While this temperature difference between the collar 78 and part 76 of rotor 44 exists, the two are united, and thereafter allowed to come to temperature equilibrium. This type of interference fit is conventionally referred to as a "shrink fit".

It will be noted that a radially outwardly disposed elongate cylindrical surface 86 of the cylindrical portion 74 is radially outwardly circumscribed and confronted by the bearing 56. That is, the surface 86 defines for the rotor member 20 a journal surface by which the rotor member is rotatably supported in housing 12. Axial location of the rotor member 20 in housing 12 is controlled by a rolling element bearing (not shown in the figures) engaging the power output shaft portion 60 (viewing FIG. 1) of the rotor member 20. The bearing 58 also serves as a thrust rolling element bearing to transmit axial forces from rotor member 20 to the housing 12.

Also defined by the ceramic rotor portion 44 is an axially extending stepped blind bore 88. The bore 88 includes a hemispherical end wall 90 which is disposed generally within the hub 68 of the rotor portion. The bore 88 terminates in an opening 92 within end part 76, and defines a step 94 disposed toward the end wall 90 and spaced intermediate the latter end wall and opening 92. Step 94 is defined by the cooperation of a smaller diameter bore portion 96 with the remainder of bore 88.

Received into the bore 88 is an elongate metallic annular collet member 98. The collet member 98 includes a circumferentially arrayed plurality of elongate radially resilient finger portions 100 integral with and extending axially from a ring portion 102 of the collet member. Each of the finger portions 100 defines a respective radially outwardly extending shoulder 104 and a radially inwardly extending step 106. The finger portions 100 may be considered to collectively define a single radially outwardly extending shoulder 104 and a single radially inwardly extending step 106. The shoulders 104 of the fingers 100 each engage the step 94 of bore 88, while a metallic locking sleeve member 108 is received within the fingers 100 and engages the steps 106 thereof. The ring portion 102 of collet 98 includes a thread-defining portion 110 into which a termination portion 112 of an elongate metallic tie bolt member 114 is threadably received. The termination portion 112 traps the locking sleeve member 108 within the fingers 100, and thereby positively prevents their disengagement from step 94. At its end opposite the termination portion 112, the tie bolt member 114 carries a nut (not visible in the figures) on a threaded part 114' thereof and which bears upon the power output shaft portion 60 of the rotor member 20. Consequently, the collet member 98 and tie bolt 114 are stressed in tension, while the remainder of the rotor member 20 rightwardly of the collet member 98 is loaded in compression.

In view of the above, it is easily seen that the coupling structure 62 is preserved in torque transmitting relative position by the axial retention effect provided by the coupling structure 64. It should be noted that compressor rotor portion 22 and power output shaft portion 60 also define a curvic coupling therebetween so that torque from turbine 44 may be delivered externally of the engine 10 via the shaft portion 60.

It will be understood that during manufacture of the rotor member 20, the metallic collet member 98 is inserted from outside through the opening 92 and into bore portion 96 such that the finger portions 100 resiliently deflect radially inwardly. This deflection of the finger portions 100 allows the shoulders 104 to pass through bore portion 96 and into the remainder of the bore 88 beyond step 94. Thereafter, the metallic locking sleeve 108 is inserted into the collet member 98 so that the fingers 100 cannot deflect radially inwardly to pass the shoulders 104 outwardly of the step 94. With the sleeve member 108 received into the collet member 98, the end termination portion 112 of the tie bolt 114 is threadably engaged at 110 with the collet member 98. Thus, the sleeve member 108 is trapped within the collet member 98, and the latter is trapped within the bore 88. Of course, reversal of the assembly procedure allows the rotor member 20 to be disassembled into its component parts, should such be desired.

Also, it will be recalled that during operation of the turbine engine 10, the turbine rotor portion 44 is exposed to a flow of high temperature pressurized combustion products. This flow of combustion products has a temperature in the range of 2000° F. (1090° C.) to 2500° F. (1370° C.), or more, and may be expected to be of an oxidizing nature. Consequently, the temperature experienced at the end of the journal bearing surface 86 closest axially to the turbine hub 68 will be about 1200° F. (650° C.). Under these conditions, a metallic journal surface at 86 would not favorably endure. That is, the surface 86, were it made of a metallic material, would oxidize and degrade, resulting in a detrimental operating condition for the journal bearing 56, and shortened operating life. On the other hand, the ceramic surface 86 of the turbine rotor portion 44 well endures 1200° F. (650° C.) operation in an oxidizing atmosphere to provide a smooth journal surface and long life for bearing 56.

Further to the above, in view of the 1200° F. (650° C.) operating temperature at surface 86 adjacent the left end of bearing 56, it is easily appreciated that the coupling structure 64 must endure temperatures in the range extending to about 1200° F. (650° C.). This high temperature at the coupling structure 64 rules out the use of all conventional shrink fit, brazed, and adhesively joined ceramic/metal joints. None of these conventional ceramic/metal joint structures are capable of enduring the operating environment which the coupling structure 64 endures very well.

Finally, it will be noted that the turbine rotor portion 44 defines a rather limited conductive heat transfer path extending from the hub part 68 rightwardly toward the coupling structures 62 and 64. That is, the turbine rotor portion 44 defines only an annular conductive heat transfer path radially between the surface 86 and the bore 88 within which heat is conducted axially rightwardly, viewing FIG. 2. Because of the relatively limited size of this heat transfer path and the distance of coupling structure 62 from the hub part 68, the operating temperatures experienced at the collar 78 are low enough to allow the shrink fit ceramic/metallic joint thereat to serve satisfactorily.

While the present invention has been depicted and described by reference to a single preferred embodiment of the invention, such reference does not imply any limitation upon the invention, and no such limitation is to be inferred. The invention is intended to be limited only by the spirit and scope of the appended claims which provide additional definition of the invention.

What is claimed is:

1. A high temperature turbine engine comprising a housing and a hybrid ceramic/metallic rotor member cooperatively defining an inlet, an outlet, and a flow path communicating a flow stream of elastic fluid therebetween, in response to rotation of said rotor member a compressor section inducting ambient air via said inlet and delivering this air pressurized to a combustor section, means delivering a supply of fuel to said pressurized air in said combustor section to support combustion producing a flow downstream in said flow path of high temperature pressurized combustion products, a turbine section expanding said flow of combustion products to extract mechanical power therefrom rotating said rotor member, said rotor member including a ceramic turbine portion having a ceramic hub part and a plurality of aeroreactive blades extending radially outwardly thereon, an integral ceramic boss part extending axially from said hub part, said boss part defining an axially extending first central bore opening on an end thereof and having an outer smaller diameter bore portion cooperating with the remainder thereof to define a step disposed away from said opening, an axially next-adjacent metallic rotor member portion confronting said boss part and defining an axially extending second bore aligning with said first bore, said turbine rotor portion and said axially next-adjacent portion including cooperating means for torque transmission and material coaxial radial alignment thereof dependent upon retention of a selected axial relationship thereof, a metallic annular collet member received axially into said first bore, said collet member including an annular ring portion and a circumferentially arrayed plurality of axially extending radially resilient finger portions extending from said ring portion to terminate at respective distal ends, said plurality of finger portions cooperatively defining a radially outwardly extending shoulder proximate said distal ends and engaging said step to retain said collet member in said first bore, an elongate tie bolt member threadably engaging said ring portion and being received in said second bore to apply an axially directed tensile force to said collet member which tensile force is reacted through said axially next-adjacent portion to retain the latter in said selected axial relationship with said first ceramic turbine portion.

2. The invention of claim 1 wherein said axially extending ceramic boss part further defines a circularly cylindrical axially elongate outer surface on said turbine rotor portion, said boss part outer surface defining a journal bearing surface for said turbine rotor.

3. The invention of claim 1 wherein said cooperating means includes said axially extending boss part carrying a metallic collar member securing thereto adjacent said end thereof, said collar member defining a first circumferentially arrayed plurality of curvic coupling teeth, said axially next-adjacent metallic portion defining a second circumferentially arrayed plurality of curvic coupling teeth meshing with said first plurality.

4. The invention of claim 3 wherein said collar member includes an axially extending annular band portion cooperating with the remainder of said collar member to define an axially extending recess, said axially extending boss part of said ceramic turbine rotor portion being received into said recess to define an interference fit relationship with said band portion.

5. The invention of claim 1 wherein a sleeve-like locking member is received axially into said collet member and is radially engageable by said plurality of finger portions to prevent disengagement of the latter from said step.

6. The invention of claim 5 further including said plurality of finger members collectively defining a radially inwardly extending second step proximate said distal finger ends, said second step being engageable by said sleeve-like locking member to prevent axial movement thereof in one axial direction.

7. The invention of claim 6 wherein said tie bolt member defines an abutment surface spaced from and confronting said second step, said abutment surface being engageable by back locking sleeve member to prevent axial movement thereof in a second direction opposite said first direction to thereby trap said sleeve member within said collet member.

8. A method of providing a hybrid ceramic/metallic rotor member for a high temperature turbine engine, said method comprising the steps of:

providing a ceramic rotor member first portion:

defining on said ceramic portion an integral axially extending boss part which in part defines an elongate axially extending bore opening on an end of said boss part;

providing a metallic rotor member second portion axially next-adjacent to said first portion;

coupling said first portion and said second portion for torque transmission therebetween and for retention of radially coaxial corotational relation dependent upon retention of a selected axial relationship therebetween:

providing on said first portion bore an outer smaller diameter bore portion cooperating with the remainder of said bore to define a step disposed away from said bore opening:

providing a metallic axially elongate collet member including an annular ring portion having an outer diameter slidably receivable axially into said smaller diameter bore portion, and a circumferentially arrayed plurality of elongate radially resilient finger portions extending axially from said ring portion to terminate in respective distal ends thereof:

defining collectively on said plurality of finger portions and proximate said distal finger ends thereof a radially outwardly extending annular shoulder having an outer diameter greater than said smaller diameter bore portion:

resiliently deflecting said plurality of finger portions radially inwardly at said distal ends thereof to reduce said shoulder to a diameter passable through said smaller diameter bore portion, passing said collet member axially into said bore to engage said shoulder with said step, applying an axially directed tensile force to said collet member directed to withdrawing the latter from said bore, and reacting said withdrawing force through said rotor member second portion to retain the latter and said first portion in said selected axial relationship.

9. The method of claim 8 wherein said step of coupling said first portion and said second portion includes the steps of:

providing on said second portion a circumferentially arrayed first plurality of axially and radially extending curvic coupling teeth:

providing a metallic collar member:

permanently securing said collar member to said first portion at said boss part:

providing on said collar member a circumferentially arrayed second plurality of curvic coupling teeth, and meshing said first plurality of teeth with said second plurality of teeth.

10. The method of claim 8 wherein said step of applying an axially directed tensile force to said collet member includes the steps of:

defining a thread surface on said ring portion of said collet member, providing an elongate tie bolt member having an end termination part threadably engageable with said collet member, threadably engaging said collet member with said tie bolt; and applying a tensile force to said tie bolt member.

11. The method of claim 8 further including the steps of:

providing a sleeve-like locking member, inserting said locking member into said collet member, and engaging radially said locking member with said plurality of finger members to prevent disengagement of the latter from said step.

* * * * *